US011547195B2

(12) United States Patent
Morehouse

(10) Patent No.: US 11,547,195 B2
(45) Date of Patent: Jan. 10, 2023

(54) TOUCHLESS, INTERNET-CONNECTED BEAUTY TESTER

(71) Applicant: Patricia Morehouse, Bethesda, MD (US)

(72) Inventor: Patricia Morehouse, Bethesda, MD (US)

( * ) Notice: Subject to any disclaimer, the term of this patent is extended or adjusted under 35 U.S.C. 154(b) by 0 days.

(21) Appl. No.: 17/737,695

(22) Filed: May 5, 2022

(65) Prior Publication Data

US 2022/0287433 A1 Sep. 15, 2022

Related U.S. Application Data

(63) Continuation of application No. 17/589,996, filed on Feb. 1, 2022.

(60) Provisional application No. 63/159,257, filed on Mar. 10, 2021.

(51) Int. Cl.

| | |
|---|---|
| ***A45D 34/04*** | (2006.01) |
| ***A47K 5/12*** | (2006.01) |
| ***A47F 7/28*** | (2006.01) |
| *A45D 34/00* | (2006.01) |

(52) U.S. Cl.

CPC ..... *A45D 34/04* (2013.01); *A47F 7/286* (2013.01); *A47K 5/1208* (2013.01); *A47K 5/1217* (2013.01); *A45D 2034/005* (2013.01); *A45D 2200/05* (2013.01); *A45D 2200/052* (2013.01); *A45D 2200/057* (2013.01)

(58) Field of Classification Search

CPC ..... A47F 7/286

See application file for complete search history.

(56) References Cited

U.S. PATENT DOCUMENTS

| | | | | |
|---|---|---|---|---|
| 2004/0226962 | A1* | 11/2004 | Mazursky | A47K 5/1217 222/64 |
| 2009/0039107 | A1* | 2/2009 | Sripada | A47F 7/286 222/105 |
| 2009/0140004 | A1* | 6/2009 | Scorgie | A47K 5/1217 222/638 |
| 2011/0155759 | A1* | 6/2011 | Weshler | A47F 7/286 222/113 |
| 2016/0256016 | A1* | 9/2016 | Yang | B05B 7/005 |
| 2018/0116428 | A1* | 5/2018 | Hagiage | B05B 12/004 |

FOREIGN PATENT DOCUMENTS

| | | | | |
|---|---|---|---|---|
| EP | 2712515 | * | 4/2014 | A45D 34/04 |

* cited by examiner

*Primary Examiner* — J C Jacyna

(74) *Attorney, Agent, or Firm* — Larry J. Guffey, Esq.; Oliver & Grimsley, LLC

(57) ABSTRACT

A universal beauty tester, that is intended for use by any one of a plurality of beauty product suppliers to allow a potential customer at a retail location to obtain a sample testing of one of the beauty products of these suppliers, includes: (a) a display housing configured to house advertising material for the beauty product in such a manner as to not allow unauthorized access to this advertising material, (b) a base, (c) a universal tester bladder that is configured to store any one of the beauty products that are being made available for testing, (d) a liquid dispensing mechanism (e) a non-contact sensing mechanism that is configured to: sense when a customer makes a motion to indicate a desire to receive a test sample of the beauty product, and dispense a test sample, and (f) a processor that controls the operation of the tester and compiles data regarding its use.

23 Claims, 6 Drawing Sheets

TOUCHLESS, INTERNET-CONNECTED BEAUTY TESTER

CROSS-REFERENCE TO RELATED APPLICATION

This application is a continuation of U.S. patent application Ser. No. 17/589,996 that was filed Feb. 1, 2022 and claims the benefit of Provisional Patent Application No. PPA 63/159,257, filed Mar. 10, 2021 by the present inventor. The teachings of these applications are incorporated herein by reference to the extent that they do not conflict with the teachings herein.

BACKGROUND OF THE INVENTION

1. Field of the Invention

The present invention relates generally to equipment for cosmetics and cosmetic treatments. More particularly, it relates to a universal beauty tester apparatus, process, method and system for dispensing, at various retail sites, samples of beauty products that take the form of a liquid or emulsion.

2. Description of the Related Art

Every year, cosmetic brands and retailers spend hundreds of millions of dollars on what are referred to in the retail industry as "beauty testers." These are the often "tester" marked, fluid dispensing devices that are found on retail shelves and configured to allow a potential customer to sample the cosmetic or beauty product associated with the tester before hopefully purchasing the product. See FIG. 1 which shows an example of such a "prior art" beauty tester that has been removed from its base that is as attachment to a retailer's shelf and the tester's motion away from its base has been restricted by the use of a retractable tether.

This process of allowing customers in retail stores to test cosmetic or beauty products at their points of purchase had changed little over the past fifty plus years until the recent occurrence of the covid pandemic. When the pandemic hit, most beauty testers were either removed from shelves, taped to shelves to prevent usage by shoppers, or remained on display with special signage advising the shopper that the tester product was "for display purposes only".

These beauty testers are reportedly quite important to new product sales as various surveys continue to show that shoppers love to sample beauty products before buying something new. They reportedly want to see, smell, touch and experience the product to know if it's the right item for them.

The manner in which these beauty testers are situated and maintained in retail stores is also pertinent to the present invention. The various cosmetic brands, manufacturers or suppliers prepare the actual beauty testers and supply them to retailers or third-party distributors, etc. who place them in the retail stores and maintain them on a regular basis (e.g., bi-weekly or monthly). These third-parties then report on the tasks they complete on each maintenance visit to their assigned retail sites (e.g., number of: (a) related beauty product items restocked, (b) items rezoned, (c) new beauty testers placed, (d) beauty testers replaced, and (e) beauty testers that are missing or damaged). Unfortunately, this "task completed data" is the only data collected regarding the beauty testers and available for one to possibly use to assess the effectiveness of using such beauty testers.

There are many problems with these beauty testers and their methods of operation. For example, they are: (a) when situated on retail shelves, often the target of thieves (e.g., some retailers report that 70% or more of their testers are stolen before they complete their expected life cycle), (b) hard to track as they move from their cosmetic manufacturers to third parties and eventually onto retail shelves (e.g., some brands report that as much as 40% of the testers they provide to retailers and third-parties never find their way onto retail shelves), (c) non-hygienic, in that individual testers are designed and intended to be touched and used by many people, (d) time consuming to maintain, and (e) devices that provide no real-time data that can be used to monitor and correlate beauty tester use and product sales.

Thus, there is a significant need for beauty tester improvements which address the problems listed above.

DESCRIPTION OF THE PREFERRED EMBODIMENT

Figure 1:
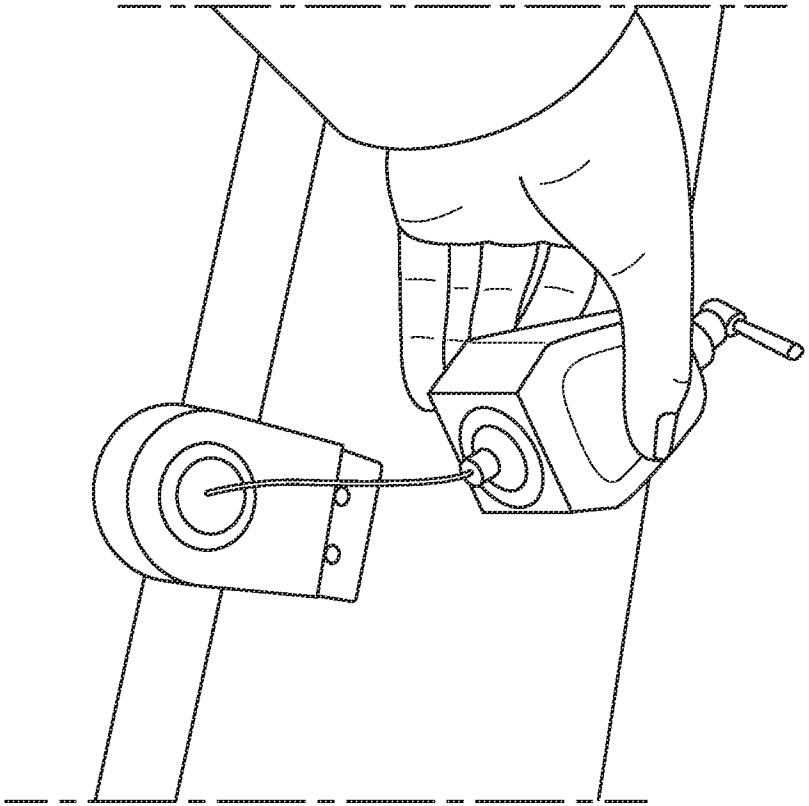
FIG. 1 (PRIOR ART)
FIG. 1 is a perspective view of a prior art, "beauty tester," in the form of the actual product itself, that has been removed from its attached-to-retailer's-shelf base; however, its motion away from its base has been restricted by the use of a retractable tether.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 2:
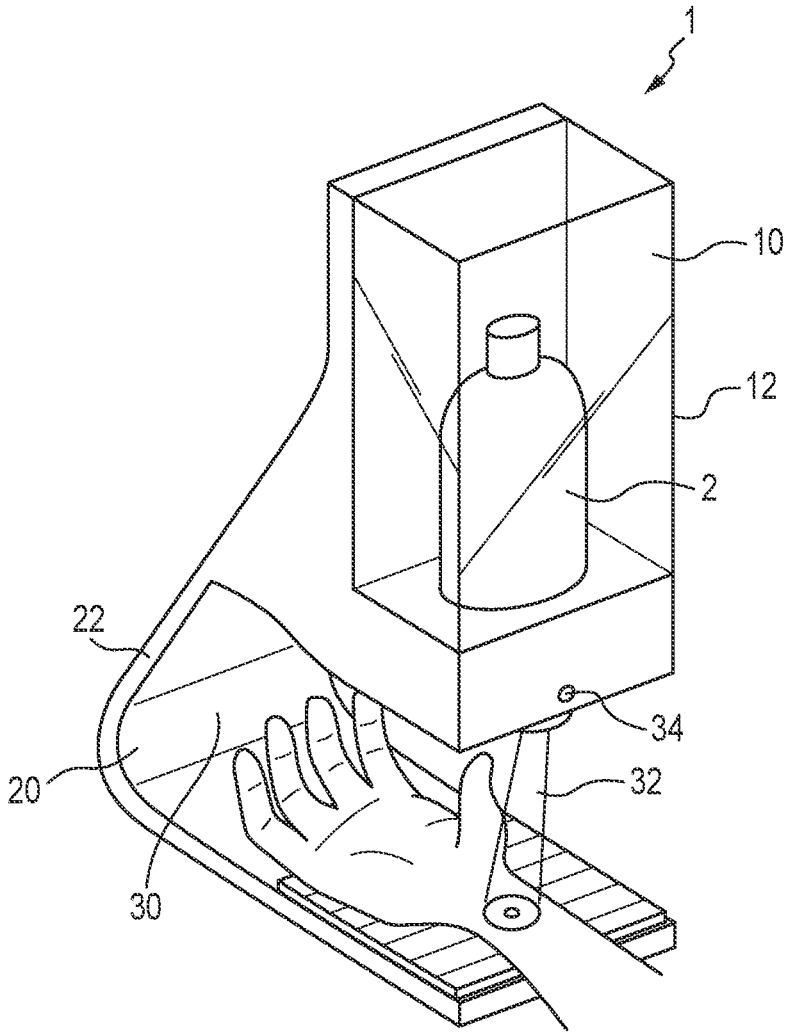
FIG. 2 is a perspective view of a preferred embodiment of the present invention in which this universal beauty tester's base is generally located below its display housing.

Referring to FIG. 2, there is illustrated a perspective view of a preferred embodiment of the present invention 1. In this embodiment, the present invention takes the form of a universal beauty tester that is intended for use by any one of a plurality of beauty product suppliers whose products take the form of a liquid or emulsion. Such testers are placed at various retail locations and allow a potential customer at these locations to obtain a sample testing of the beauty product that is stored in the tester; and wherein, because the tester's universal nature, this sample can be any one of the products of the many beauty product suppliers who have access to such a tester.

This tester is seen to have a display housing 10 with an outer surface 12 that is configured to house within it a sample of the marketing-distinctive vessel 2 or advertising materials for the beauty product whose contents is to be sampled. This housing is further configured to: (i) not allow unauthorized access to the interior region of the housing so as to deny one access to the product's marketing-distinctive vessel 2, and (ii) have a transparent portion that allows one to see the product's marketing-distinctive vessel.

Figure 5:
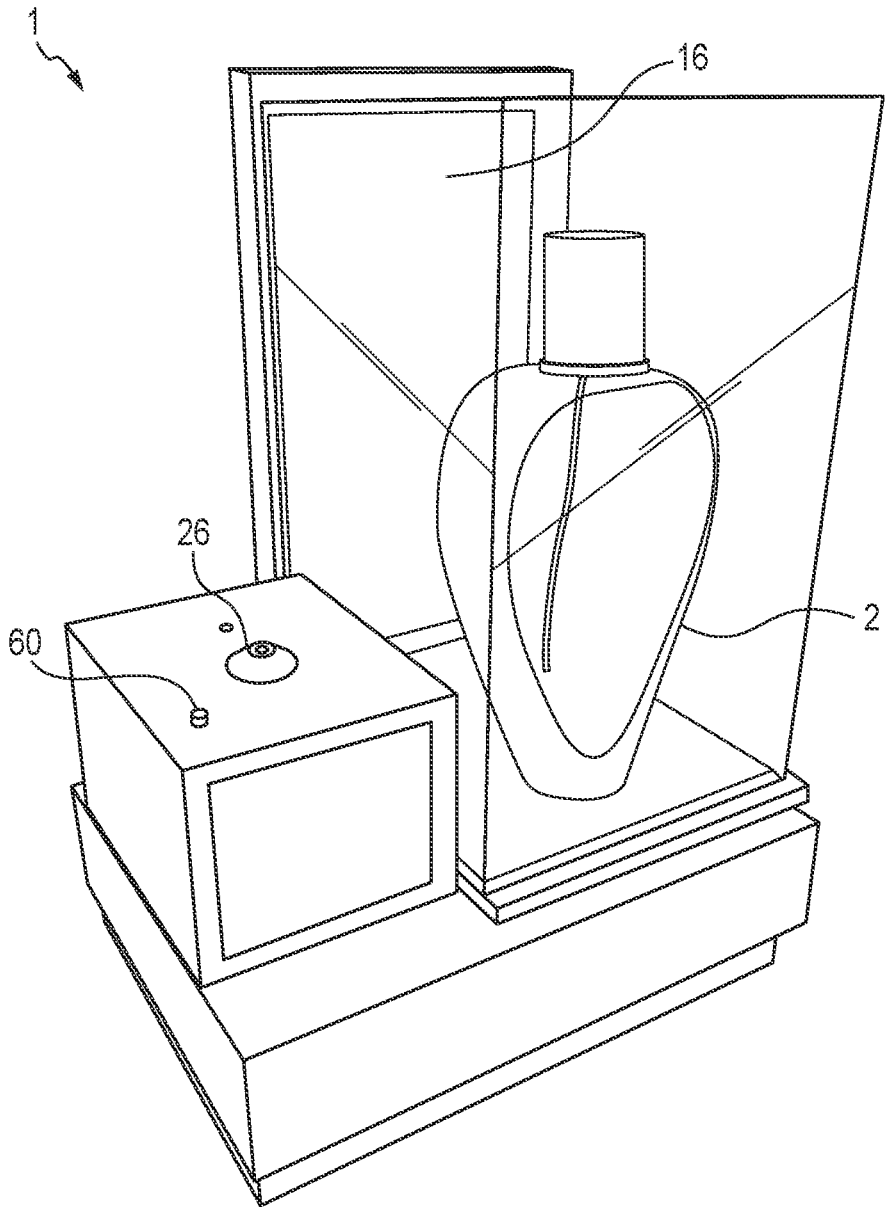
FIG. 5 is a second, perspective view of the preferred embodiment shown in FIG. 1, but where the universal beauty tester's base is generally adjacent to its display housing.
Figure 6:
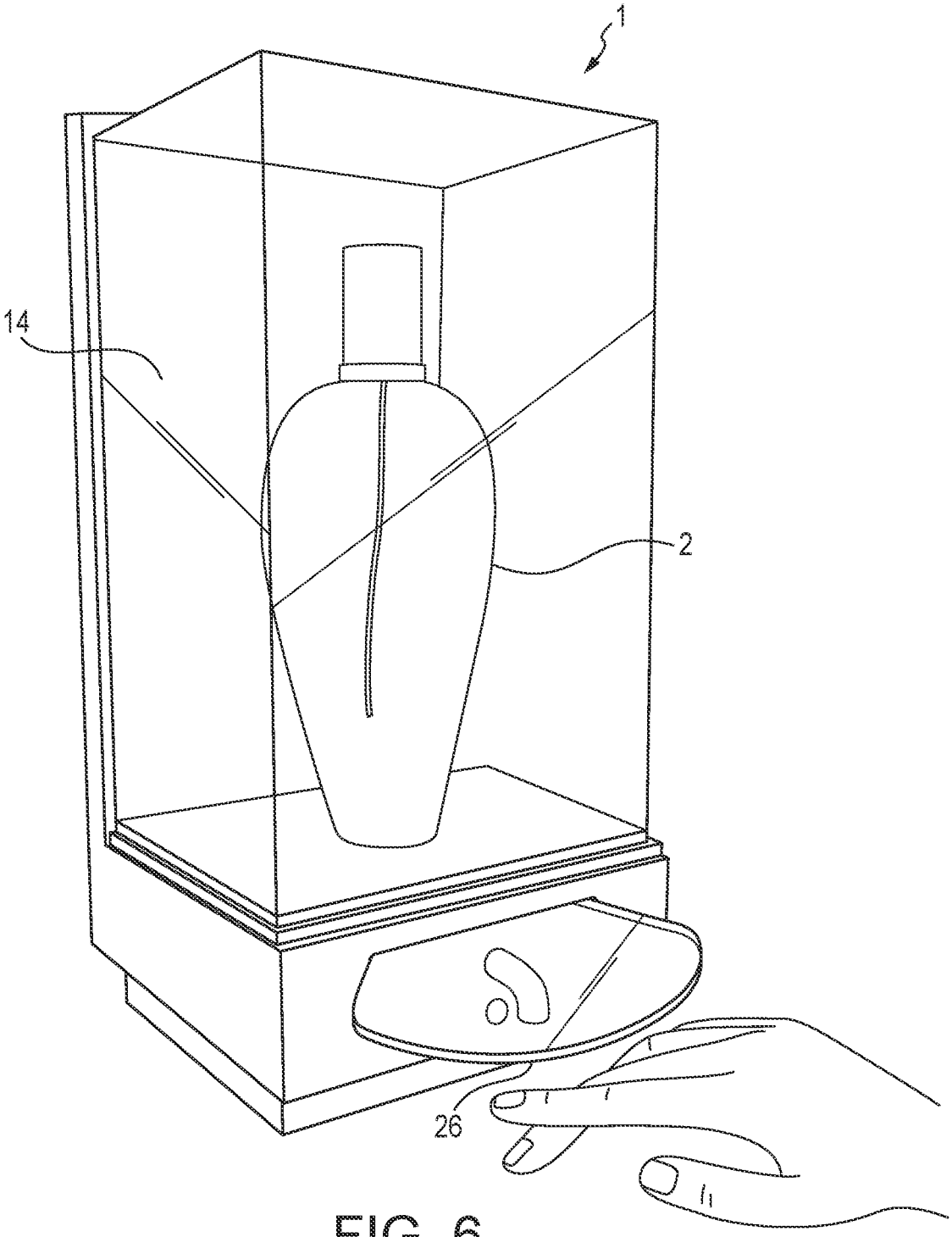
FIG. 6 is a perspective view of a preferred embodiment of the present invention that has been configured to dispense a fragrance sample when a potential customer's hand is place proximate the tester's dispensing mechanism.

This housing 10, in fulfilling its display function, can also have other design features. For example, it can have: (a) a portion that has LED lighting 14 to draw attention to the vessel within it (See FIG. 6), (b) the ability to display a graphical insert 16 that also seeks to draw attention to the vessel or product within the tester (See FIG. 5), and (c) various digital player options that allow for the use of video and audio renderings that also serve as advertisements and seek to draw one's attention to the product within the tester.

Figure 3:
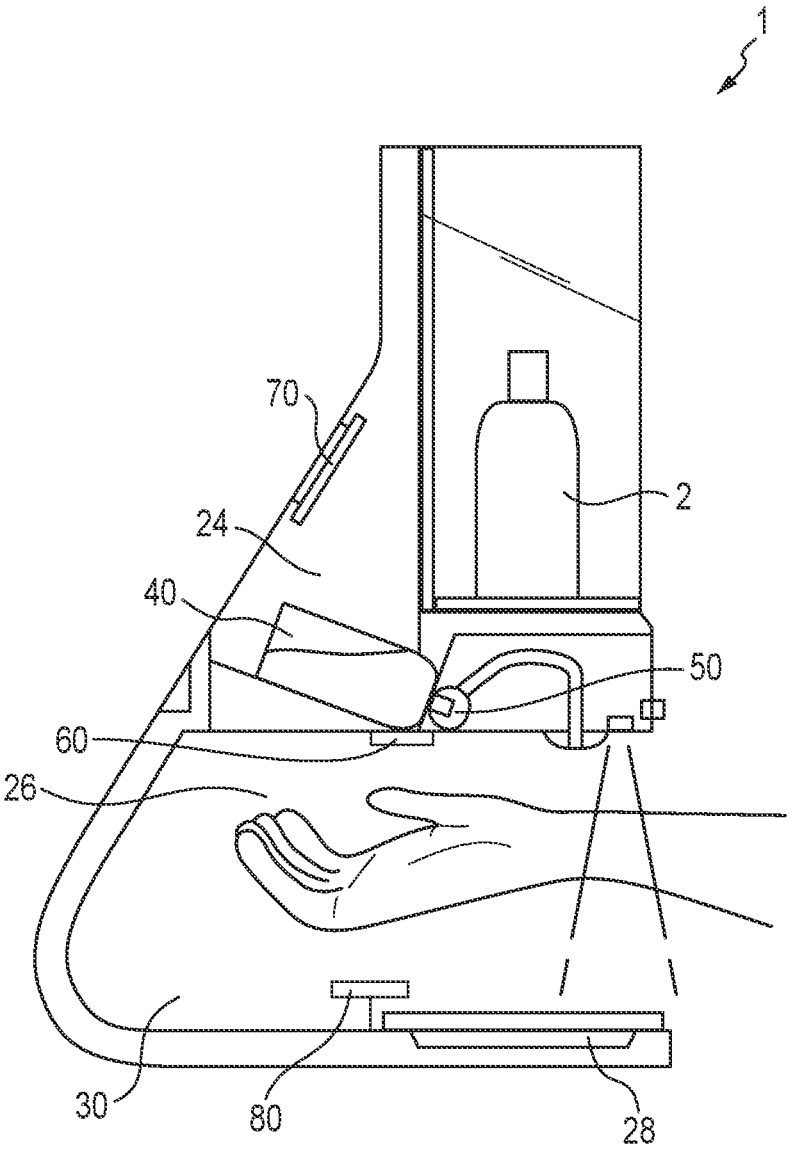
FIG. 3 is a cross-sectional view of the preferred embodiment shown in FIG. 1.
Figure 4:
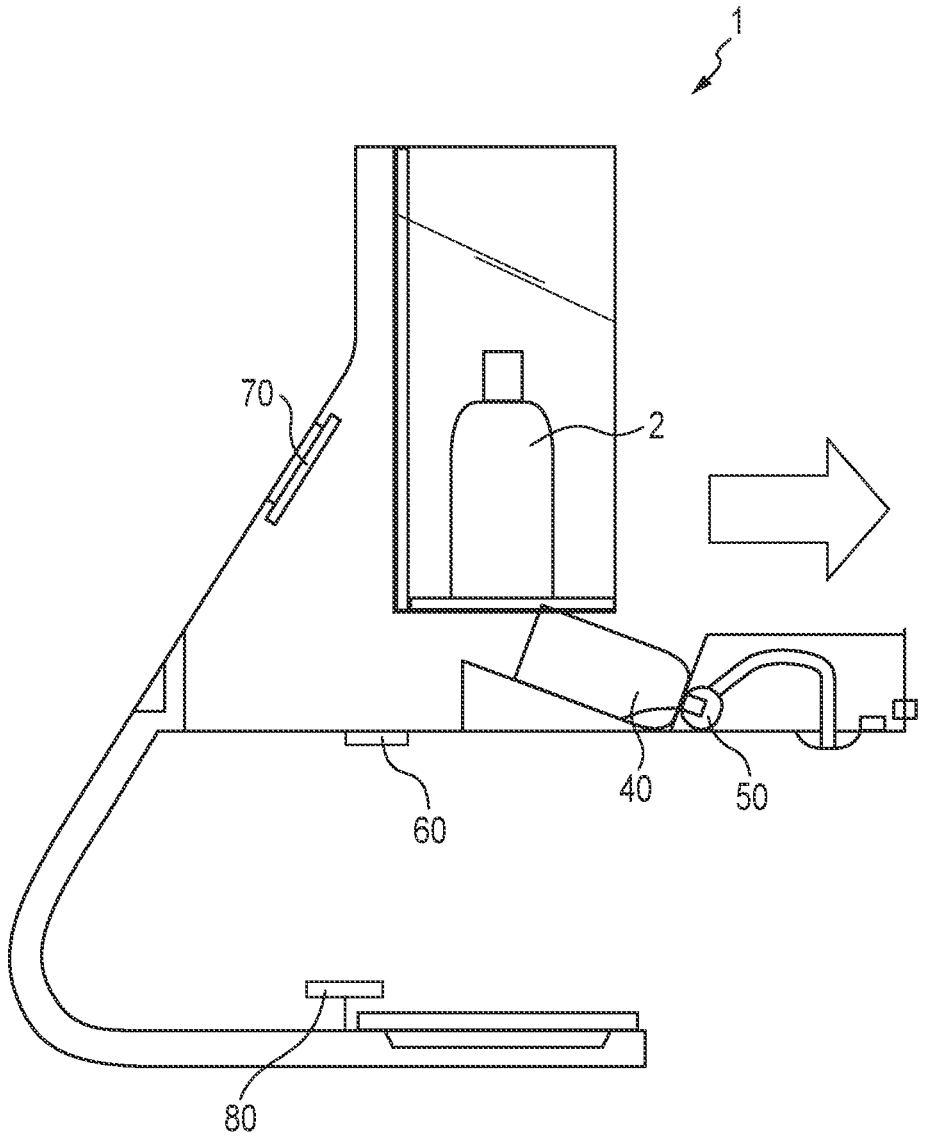
FIG. 4 is a second, cross-sectional view of the preferred embodiment shown in FIG. 1, but with the universal beauty tester's bladder or tester bottle pulled forward so that it can be refilled or replaced.

Attached to this housing is a base 20 that has a bounding surface 22 which has an interior region 24 and a dispensing zone 26 into which the liquid, of the beauty product represent by the marketing-distinctive vessel 2 in the housing, is dispensed. See FIGS. 3-4. This base can also have other features that adds to its usefulness. For example, it can have: (a) a removable drip tray 28 that collects any residue of the dispensed beauty product sample, (b) a region 30 sized to allow one who wishes to test the tester's product to place one's hand/wrist into the tester in order to receive the dispensed beauty product, (c) a means for projecting a light beam 32 that marks the region where one should place his/her hand to receive the to-be-dispensed beauty product, (d) a LED or similar light 34 that can be cycled on & off to indicate to a potential customer that a sample of the tester's beauty product is about to be dispensed.

In the base's interior region, there is located a removable and reusable, universal tester bladder or container 40 that is configured to temporarily store, until it is dispensed, a specific quantity of any one of the plurality of beauty products that are being made available for testing. It is the nature of this bladder that helps to make the present invention so useful. For example, the use of this universal & reusable bladder means that: (1) beauty product suppliers can now only supply their liquids or emulsions that go into these bladders; thus, they no longer have to supply the expensive and marketing-distinctive vessels that are usually used with their products and which are often stolen are never find their way onto retailer's shelves, and (2) since these bladders can be hygienically cleaned and reused, the beauty testers of the present invention can be used with multiple types of beauty products.

Also within the base's interior region, there is located a liquid or emulsion dispensing mechanism 50 that detachably connects (i.e., to allow the mechanism to be disconnected so that the bladder can be filled) to the bladder and periodically, and when a potential customer makes the appropriate motion to activate a motion sensor 60 connected to the dispensing mechanism, dispenses a specified, sample quantity of the tester's currently residing product. The configuration of this dispensing mechanism is such that it can dispense a wide range of liquids having differing viscosities and densities. It can also be adjusted to provide the dispensed product in a format that ranges from a continuous liquid stream to an atomized mist consisting of fine, liquid droplets.

The present invention's motion sensor 60 or non-contact, sensing mechanism is also attached to the base and located proximate the tester's dispensing zone 26 and configured to: (i) sense when a potential customer makes a motion in the region proximate the non-contact sensing mechanism 60 to indicate a desire to receive a test sample of the beauty product currently stored in the tester's bladder 40, and (ii) send a signal to the liquid dispensing mechanism 50 that causes the dispensing of a test sample of the bladder's contents.

An important feature of the present invention is its ability to collect data on when product test samples are dispensed and then automatically distribute this data to interested parties. This and the operational features of the tester are accomplished by providing it with a microprocessor or processor 70, which has memory (in which resides a database), input and output ports (i.e., connection points that acts as an interface between the computer and external devices like a mouse, a printer, a modem, etc.), a means for connecting to a network or the internet and the necessary control software that controls the tester's operation and allows one utilizing the network and having proper access to the microprocessor to monitor the activity of the tester.

As previously mentioned, the tester springs into action when presumably a potential customer makes a motion with his/her hand in the region being monitored by the testers' motion sensor 60. The motion sensor then generates an output signal that goes to the microprocessor 70 and its software reacts to this incoming signal by causing a record (i.e., time and quantity) to be made of this dispensing action in the tester's database and also causes a signal to be sent to the dispensing mechanism 50 that results in it dispensing a specified quantity of the beauty product currently residing in the tester's bladder 40.

This universal beauty tester 1 can also be equipped with various functionality or operational-assessing sensors 80. For example, a liquid sensor can be placed in the tester's dispensing zone 26 to temporally monitor for the presence of a liquid passing through this zone and, when this happens, to send a functionality signal to the microprocessor 70. The microprocessor's software then checks to see if such a signal is received after each dispensing action of the dispensing mechanism. When this repeatedly does not occur during a prescribed monitoring period, an alarm signal is generated to indicate that the tester 1 is not functioning properly. Because of the microprocessor's linkage to the internet, the microprocessor's software can be used to send this alarm signal to the appropriate parties who are responsible for the tester's functioning.

The computerization of this beauty tester invention, and its ability to automatically collect and share various data regarding the testers' operation (data that was not previously collected), means that it can be used to try to optimize all aspects of the marketing of the cosmetic or beauty products that are used in its samplers. For example, the tester's collected data can be combined with other data that is regularly collected by retailers (e.g., retailer point-of-sale data, shopper traffic data, category sales data, year ago sales data, inventory data, on-line sales data) to help provide feedback on the effectiveness of the design of the retailer's store shelves and display fixtures.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereinafter set forth in the claims to the invention.

I claim:

1. A method of providing a test sample of a beauty product at a retail location, said method comprising the steps of:

providing a display housing having an outer surface and configured to house a marketing-distinctive vessel for said beauty product, that is one of a plurality of beauty products that are being made available for testing, in such a manner as to not allow unauthorized access to said marketing-distinctive vessel, and wherein said outer surface having a transparent portion that allows one to see said marketing-distinctive vessel, providing a base that adjoins said display housing and has a bounding surface, an interior region and a dispensing zone, detachably affixing a universal tester bladder, at a location in said base interior region, that is configured to be hygienically cleanable so that said universal tester bladder is reusable to store a specific quantity of any one of said plurality of beauty products, providing a dispensing mechanism that is connected to said base and reactive to an input signal and configured to, upon the receipt of said input signal, cause said universal tester bladder to dispense, into said base dispensing zone, a specified quantity of said beauty product that is currently stored in said universal tester bladder, providing a processor in said base that has a memory, that includes a database and software, and a port configured for connecting to a network, and wherein said dispensing mechanism further configured to create and send a dispensing output signal to said processor which indicates dispensing information, including the time of dispensing, and the amount dispensed of said test sample of said beauty product currently stored in said universal tester bladder.

2. The method as recited in claim 1, further comprising the step of:

providing a non-contact sensing mechanism that is attached to said base and configured to: (1) sense when a customer makes a motion in a region proximate said non-contact sensing mechanism to indicate a desire to receive a test sample of said beauty product currently stored in said universal tester bladder, and (11) send said input signal to said dispensing mechanism that causes the dispensing of said test sample.

3. The method as recited in claim 1, further comprising the step of:

providing a functionality sensor that is attached to said universal beauty tester and configured to monitor the functionality of said universal beauty tester and send a functionality output signal to said processor which indicates the operational functionality of said universal beauty tester.

4. The method as recited in claim 2, further comprising the step of:

providing a functionality sensor that is attached to said universal beauty tester and configured to monitor the functionality of said universal beauty tester and send a functionality output signal to said processor which indicates the operational functionality of said universal beauty tester.

5. The method as recited in claim 2, further comprising the step of:

configuring said universal tester bladder to detachably connect to said dispensing mechanism to provide for the filling of said universal tester bladder with said beauty product for which said test sample is to be dispensed, and configuring base bounding surface to provide a request space in which a customer makes a motion to indicate that said customer desires to receive a test sample of said beauty product that is currently stored in said universal tester bladder.

6. The method as recited in claim 4, further comprising the step of:

configuring said universal tester bladder to detachably connect to said dispensing mechanism to provide for the filling of said universal tester bladder with said beauty product for which said test sample is to be dispensed, and configuring base bounding surface to provide a request space in which a customer makes a motion to indicate that said customer desires to receive a test sample of said beauty product that is currently stored in said universal tester bladder.

7. The method as recited in claim 1, wherein:

said software includes instructions that causes said processor to: (a) record in said database said dispensing information, and (b) allow one utilizing said network to access said dispensing information.

8. The method as recited in claim 2, wherein:

said software includes instructions that causes said processor to: (a) record in said database said dispensing information, and (b) allow one utilizing said network to access said dispensing information.

9. The method as recited in claim 3, wherein:

said software includes instructions that causes said processor to: (a) record in said database said dispensing information, and (b) allow one utilizing said network to access said dispensing information.

10. The method as recited in claim 4, wherein:

said software includes instructions that causes said processor to: (a) record in said database said dispensing information, and (b) allow one utilizing said network to access said dispensing information.

11. The method as recited in claim 5, wherein:

said software includes instructions that causes said processor to: (a) record in said database said dispensing information, and (b) allow one utilizing said network to access said dispensing information.

12. The method as recited in claim 6, wherein: said software includes instructions that causes said processor to: (a) record in said database said dispensing information, and (b) allow one utilizing said network to access said dispensing information.

13. The method as recited in claim 7, wherein: said software further includes instructions that causes said processor to: (c) monitor said functionality output signal and issue an alert over said network when there is a problem with the operational functionality of said universal beauty tester.

14. The method as recited in claim 8, wherein:

said software further includes instructions that causes said processor to: (c) monitor said functionality output signal and issue an alert over said network when there is a problem with the operational functionality of said universal beauty tester.

15. The method as recited in claim 9, wherein:

said software further includes instructions that causes said processor to: (c) monitor said functionality output signal and issue an alert over said network when there is a problem with the operational functionality of said universal beauty tester.

16. The method as recited in claim 10, wherein:

said software further includes instructions that causes said processor to: (c) monitor said functionality output signal and issue an alert over said network when there is a problem with the operational functionality of said universal beauty tester.

17. A universal beauty tester comprising:

a display housing having an outer surface and configured to house a marketing-distinctive vessel for a beauty product, that is one of a plurality of beauty products that are being made available for testing, in such a manner as to not allow unauthorized access to said marketing-distinctive vessel, and wherein said outer surface having a transparent portion that allows one to see said marketing-distinctive vessel, a base that adjoins said display housing and has a bounding surface, an interior region and a dispensing zone, a universal tester bladder that is configured to be hygienically cleanable so that said universal tester bladder is reusable to store a specific quantity of any one of said plurality of beauty products, wherein said universal tester bladder is detachably affixed at a location in said base interior region, a dispensing mechanism that is connected to said base and reactive to an input signal and configured to, upon the receipt of said input signal, cause said universal tester bladder to dispense, into said base dispensing zone, a specified quantity of said beauty product that is currently stored in said universal tester bladder, a processor in said base that has a memory, that includes a database; and software, and t and a port configured for connecting said processor to a network, and wherein said dispensing mechanism further configured to create and send a dispensing output signal to said processor which indicates dispensing information, including the time of dispensing, and the amount dispensed of said test sample of said beauty product currently stored in said universal tester bladder.

18. The universal beauty tester as recited in claim 17, further comprising:

a non-contact sensing mechanism that is attached to said base and configured to: (1) sense when a customer makes a motion in a region proximate said non-contact sensing mechanism to indicate a desire to receive a test sample of said beauty product currently stored in said universal tester bladder, and (11) send said input signal to said dispensing mechanism that causes the dispensing of said test sample, a processor in said base that has a memory, that includes a database, and software, and a port configured for connecting said processor to a network, wherein said dispensing mechanism further configured to create and send a dispensing output signal to said processor which indicates dispensing information, including the time of dispensing, and the amount dispensed of said test sample of said beauty product currently stored in said universal tester bladder.

19. The universal beauty tester as recited in claim 17, further comprising:

a functionality sensor that is attached to said universal beauty tester and configured to monitor the functionality of said universal beauty tester and send a functionality output signal to said processor which indicates the operational functionality of said universal beauty tester.

20. The universal beauty tester as recited in claim 18, further comprising:

a functionality sensor that is attached to said universal beauty tester and configured to monitor the functionality of said universal beauty tester and send a functionality output signal to said processor which indicates the operational functionality of said universal beauty tester.

21. The universal beauty tester as recited in claim 18, wherein:

said universal tester bladder is further configured to detachably connect to said dispensing mechanism to provide for the filling of said universal tester bladder with said beauty product for which said test sample is to be dispensed, and said base outer surface is configured to provide a space in which a customer makes a motion to indicate that said customer desires to receive a test sample of said beauty product that is currently stored in said universal tester bladder.

22. The universal beauty tester as recited in claim 17, wherein:

said software includes instructions that causes said processor to: (a) record in said database said dispensing information, and (b) allow one utilizing said network to access said dispensing information.

23. The universal beauty tester as recited in claim 22, wherein:

said software includes instructions that causes said processor to: (c) monitor said functionality output signal and issue an alert over said network when there is a problem with the operational functionality of said universal beauty tester.

* * * * *